US007984764B2

(12) United States Patent
Leonardi et al.

(10) Patent No.: US 7,984,764 B2
(45) Date of Patent: Jul. 26, 2011

(54) ACCUMULATOR FOR SUBSEA EQUIPMENT

(75) Inventors: Tauna Leonardi, Pearland, TX (US); Joseph D. Scranton, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/567,350

(22) Filed: Sep. 25, 2009

(65) Prior Publication Data

US 2010/0071907 A1 Mar. 25, 2010

Related U.S. Application Data

(62) Division of application No. 11/379,172, filed on Apr. 18, 2006, now Pat. No. 7,628,207.

(51) Int. Cl.
*E21B 7/12* (2006.01)

(52) U.S. Cl. ..... 166/338; 166/368; 166/344; 60/413; 138/31

(58) Field of Classification Search ..... 166/335, 166/338, 344, 363, 364, 368; 138/31; 60/398, 60/416

See application file for complete search history.

(56) References Cited

U.S. PATENT DOCUMENTS

| | | | | |
|---|---|---|---|---|
| 2,790,462 | A | | 4/1957 | Ashton et al. |
| 2,937,663 | A | | 5/1960 | Ashton et al. |
| 3,174,505 | A | | 3/1965 | Bauer et al. |
| 3,509,910 | A | | 5/1970 | Nelson et al. |
| 3,583,480 | A | | 6/1971 | Regan |
| 3,646,962 | A | | 3/1972 | Jones |
| 3,677,001 | A | | 7/1972 | Childers et al. |
| 3,918,498 | A | | 11/1975 | Schneider |
| 3,921,500 | A | * | 11/1975 | Silcox ..... 91/4 R |
| 3,987,708 | A | | 10/1976 | Uhrich |
| 4,043,352 | A | | 8/1977 | Simpson |
| 4,234,043 | A | | 11/1980 | Roberts |
| 4,325,434 | A | | 4/1982 | Roberts |
| 4,640,096 | A | | 2/1987 | Lechon et al. |
| 4,644,976 | A | | 2/1987 | Peter et al. |
| 4,649,704 | A | * | 3/1987 | Marsh ..... 60/415 |
| 4,693,276 | A | | 9/1987 | Fulmer |
| 4,777,800 | A | | 10/1988 | Hay, II |
| 4,819,697 | A | * | 4/1989 | Randa et al. ..... 138/30 |
| 5,624,105 | A | * | 4/1997 | Runkel ..... 267/64.15 |
| 6,125,938 | A | | 10/2000 | Garcia-Soule et al. |

(Continued)

FOREIGN PATENT DOCUMENTS

WO 2005070001 A2 8/2008

*Primary Examiner* — Thomas A Beach

(74) *Attorney, Agent, or Firm* — Kevin B. McGoff; Rodney V. Warfford

(57) ABSTRACT

Pressure-balanced accumulator apparatus for use in subsea operations is disclosed which comprises a housing and an accumulator within the housing at the first end of the housing. The accumulator has first and second chambers that are hermetically sealed from one another, with a pressurized gas in the first chamber and a pressurized fluid in the second chamber. A third chamber in the housing abuts the accumulator and contains silicon oil fluid. A movable piston is located within the housing proximate the second end of the housing. Ambient pressure is communicated to one end of the piston, and ambient pressure plus the pressure in the second chamber is communicated to the second end of the piston. The cross-sectional areas of the two ends of the piston are selected to optimize the pressure at which the piston begins to expel fluid from the second chamber.

5 Claims, 3 Drawing Sheets

U.S. PATENT DOCUMENTS

| | | | | |
|---|---|---|---|---|
| 6,192,680 | B1 * | 2/2001 | Brugman et al. | 60/398 |
| 6,202,753 | B1 | 3/2001 | Baugh | |
| 6,250,199 | B1 * | 6/2001 | Schulte et al. | 91/4 R |
| 6,418,970 | B1 | 7/2002 | Deul | |
| 6,505,691 | B2 * | 1/2003 | Judge et al. | 175/70 |
| 6,834,680 | B2 | 12/2004 | Baugh | |
| 7,137,450 | B2 | 11/2006 | Johansen et al. | |
| 7,152,932 | B2 * | 12/2006 | Kuznicki et al. | 303/87 |
| 7,159,662 | B2 | 1/2007 | Johansen et al. | |
| 7,353,845 | B2 * | 4/2008 | Underwood et al. | 138/30 |
| 7,424,917 | B2 | 9/2008 | Martin | |
| 7,520,129 | B2 * | 4/2009 | Springett | 60/398 |
| 2005/0074296 | A1 | 4/2005 | McCarty et al. | |
| 2005/0077049 | A1 | 4/2005 | Moe et al. | |
| 2005/0155658 | A1 | 7/2005 | White | |
| 2008/0245432 | A1 | 10/2008 | Lenz | |

* cited by examiner

ACCUMULATOR FOR SUBSEA EQUIPMENT

CROSS-REFERENCE TO RELATED APPLICATIONS

This application is a Divisional of U.S. patent application Ser. No. 11/379,172, filed Apr. 18, 2006, which is incorporated herein by reference in its entirety.

BACKGROUND OF THE INVENTION

1. Field of the Invention

The present invention relates to an accumulator for use in controlling an in-riser or open water intervention system such as a subsea stack of Subsea Test Tree ("SSTT") and the valves associated therewith.

2. Description of the Prior Art

Accumulators are devices that provide a reserve of hydraulic fluid under pressure and are used in conventional hydraulically-driven systems where hydraulic fluid under pressure operates a piece of equipment or a device. The hydraulic fluid is pressurized by a pump that maintains the high pressure required.

If the piece of equipment or the device is located a considerable distance from the pump, a significant pressure drop can occur in the hydraulic conduit or pipe which is conveying the fluid from the pump to operate the device. Therefore, the flow may be such that the pressure level at the device is below the pressure required to operate the device. Consequently, operation may be delayed until such a time as the pressure can build up with the fluid being pumped through the hydraulic line. This result occurs, for example, with deep water applications, such as with SSTT and BOP equipment, which is used to shut off a well bore to secure an oil or gas well from accidental discharges to the environment. Thus, accumulators may be used to provide a reserve source of pressurized hydraulic fluid for this type of equipment. In addition, if the pump is not operating, accumulators can be used to provide a reserve source of pressurized hydraulic fluid to enable the operation of a piece of equipment or device.

Accumulators conventionally include a compressible fluid, e.g., gas, nitrogen, helium, air, etc., on one side of a separating mechanism, and a non-compressible fluid (hydraulic fluid) on the other side. When the hydraulic system pressure drops below the precharged pressure of the gas side, the separating mechanism will move in the direction of the hydraulic side displacing stored hydraulic fluid into the piece of equipment or the device as required.

When a conventional accumulator is exposed to hydrostatic pressure, such as encountered in subsea operations, the available hydraulic fluid is decreased since the hydrostatic pressure must first be overcome in order to displace the hydraulic fluid from the accumulator. Once the conventional accumulator begins to displace fluid, the pressure of the non-compressible fluid decreases and cannot overcome the hydrostatic pressure thus causing the remaining fluid in the conventional accumulator to become essentially unusable. This is typically compensated for by increasing the precharge in the secondary chamber in the conventional accumulator to compensate for the hydrostatic pressure. In these conventional accumulators, the precharge must usually be adjusted for each operating depth in order optimizes the conventional accumulators' available liquid volume. In a deep subsea well, the gas precharge pressure may be higher than the hydraulic fluid pressure rendering the accumulator useless when testing the hydraulic circuit at the surface. A conventional accumulator has the further shortcoming that it cannot be used at several different depths and unless it is used at the depth for which it is configured, it may still have an amount of unusable hydraulic fluid.

Pressure-balanced accumulators have been proposed to overcome the above-described shortcomings of a conventional accumulator. Pressure-balanced accumulators are, for example, disclosed in U.S. Pat. No. 6,202,753 to Benton and U.S. Patent Publication No. 2005/0155658-A1 to White.

SUMMARY OF THE INVENTION

In accordance with the present invention, pressure-balanced accumulator apparatus is provided for use in subsea operations. The apparatus comprises a housing having first and second ends where the housing comprises a generally tubular-shaped member, and an accumulator is located within the housing proximate the first end of the housing. The accumulator comprises a first chamber for receiving a pressurized gas at a first pressure and a second chamber for receiving a first pressurized fluid at a second pressure known as the gauge pressure. The first and second chambers are hermetically sealed from one another.

Apparatus in accordance with the present invention further comprises a third chamber which abuts one end of the accumulator. The third chamber contains a second fluid which is under pressure, and the pressure of the second fluid in the third chamber tracks the pressure of the pressurized fluid in the second chamber of the accumulator. In one embodiment, the fluid in the third chamber may be silicon oil.

Apparatus in accordance with the present invention also comprises a movable piston which is located within the housing proximate the second end of the housing. The movable piston has first and second ends with first and second cross-sectional areas, respectively. The piston is movable between a first position and a second position within the housing, and the second end of the housing includes a port to permit ambient pressure to impinge on the first end of the piston. The second end of the piston is in contact with the third chamber. When the force imparted to the first end of the piston by the hydrostatic pressure exceeds the force imparted to the second end of the piston by the sum of the hydrostatic pressure and the pressure of the fluid in the second chamber, the piston will begin to move, thereby expelling fluid from the second chamber of the accumulator. The cross-sectional areas of the first and second ends of the piston may be selected so as to maximize the gauge pressure of the second chamber at which the piston will start to move, while at the same time in maintaining an operating safety margin.

Apparatus in accordance with the present invention further comprises an atmospheric chamber. In one embodiment, the atmospheric chamber includes an annular recess which is formed between a portion of the piston proximate its first end and the wall of the generally tubular-shaped housing, an axial cavity formed in the piston, and a passage connecting the annular recess and the axial cavity. This atmospheric chamber comprises a preselected volume of air which is at 1 atmosphere (14.7 psi). The atmospheric chamber functions to create a differential pressure which allows the piston to move from the first position to the second position when the above-described forces exist on the piston. In one embodiment, the volume of this annual recess is approximately 210 $in^3$.

In one embodiment of the present invention, the first chamber of the accumulator is pre-charged with pressurized helium. This helium may, for example, be pressurized to approximately 3500 psi.

In one embodiment of the present invention, the second chamber of the accumulator is charged with a pressurized fluid at about 5000 psi. Many suitable fluids exist for use in the second chamber of the accumulator, and the fluid in the second chamber may, for example, be a water-glycol mixture.

In one embodiment of apparatus in accordance with the present invention, the first end of the piston has a circular cross-sectional area with a diameter of approximately 3.375 inches and the second end of the piston also has a circular cross-sectional area with a diameter of approximately 2.688 inches.

DESCRIPTION OF SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 1:
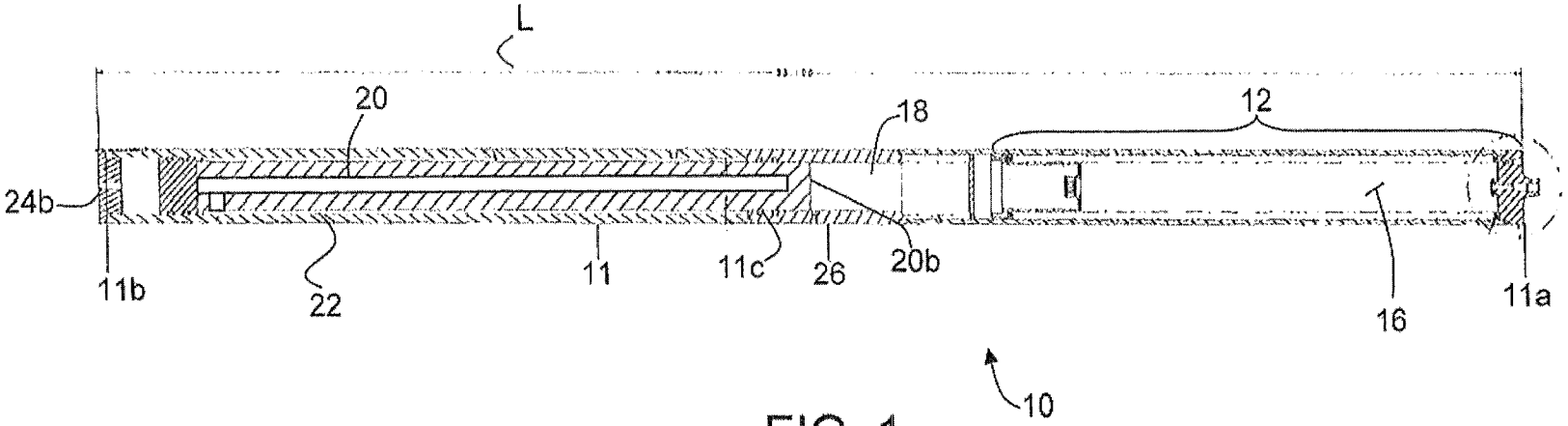
FIG. 1 is a cross-sectional view taken along the longitudinal axis of apparatus in accordance with the present invention.
Figure 2:
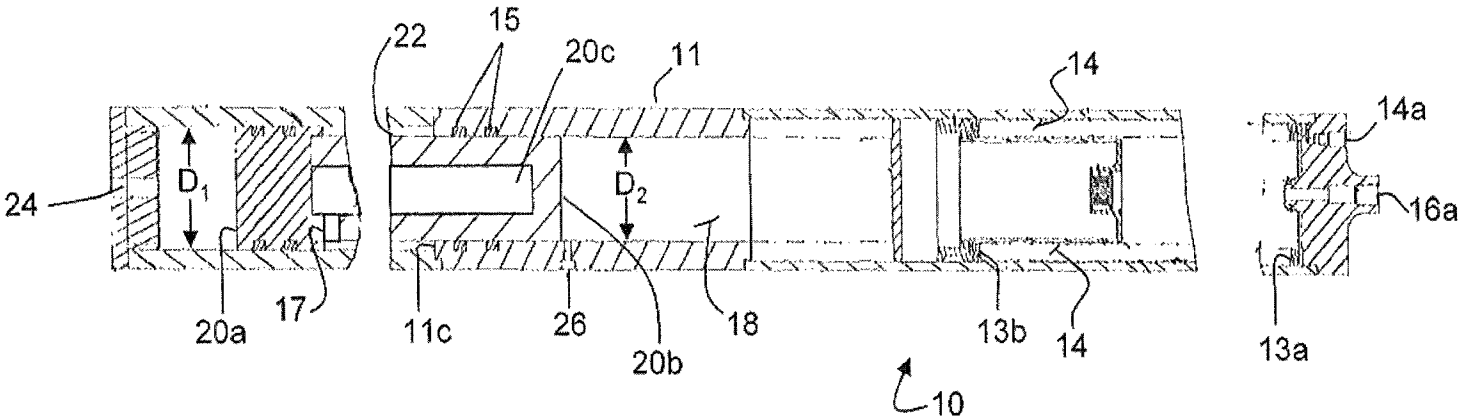
FIG. 2 is an enlarged cross-sectional view of portions of the apparatus of FIG. 1.

With reference to both FIGS. 1 and 2, apparatus 10 in accordance with the present invention comprises housing 11, which is a generally tubular-shaped member having two ends 11*a* and 11*b*. An accumulator 12 is located within the housing 11 proximate the first end 11*a* thereof. The accumulator 12 comprises a first chamber 14 for receiving a pressurized gas at a first pressure. The pressurized gas may, for example, be injected into chamber 14 through gas precharge port 14*a*. In one embodiment of the present invention, the gas in the first chamber is helium, and it is pressurized to approximately 3500 psi.

Still referring to FIGS. 1 and 2, accumulator 12 further comprises a second chamber 16 for receiving a first pressurized fluid at a second pressure. The pressure of the fluid in chamber 16 is sometimes referred to as the "gauge pressure." In one embodiment of the present invention, the liquid may be injected into chamber 16 via seal stab port 16*a*. The liquid injected into chamber 16 is a water glycol mixture in one embodiment of the present invention, and that mixture may be injected into chamber 16 at a pressure of approximately 5000 psi. Chambers 14 and 16 are hermetically sealed from one another at 13*a* and 13*b*.

Apparatus 10 further comprises a third chamber 18 which abuts accumulator 12 in housing 11. Third chamber 18 contains a fluid, which may be injected into chamber 18 via fluid fill port 26. In one embodiment, the fluid injected into third chamber 18 is silicon oil, which is selected for use because of its lubricity and because it will not adversely affect the seals 15. Initially, the silicon fluid is not injected into third chamber 18 under pressure. In operation, however, the pressure of the fluid in chamber 18 will track the pressure of the fluid in chamber 16, as described below.

Still with reference to FIGS. 1 and 2, apparatus 10 further comprises a piston 20 which is located within the housing proximate the second end 11*b* of housing 11. The piston has a first end 20*a* and a second end 20*b* which have first and second cross-sectional areas, respectively. In one embodiment, the cross-sectional areas of piston ends 20*a* and 20*b* are circular. Piston 20 is movable between a first position as shown in FIG. 1 to a second position where piston end 20*a* is stopped by shoulder 11*c*.

End 11*b* of apparatus 10 includes ambient pressure port 24. When apparatus 10 is used in a subsea environment, ambient pressure port 24 will permit the ambient subsea pressure to impinge on end 20*a* of piston 20.

Still with reference to FIGS. 1 and 2, apparatus 10 further comprises an atmospheric chamber which includes the annular recess 22 which is formed between piston 20 and the wall of tubular member 11, axial cavity 20*c* which is formed by hollowing out a portion of piston 20, and the passage 17 connecting annular recess 22 and axial cavity 20*c*. This atmospheric chamber allows differential pressure to exist across piston 20 which enables the piston to start to move where an equilibrium pressure exists across piston 20 as discussed below. In one embodiment, the pressure in the atmospheric chamber is 14.7 psi, the volume of annular recess 22 is approximately 10 $in^3$, and the volume of axial cavity 20*c* is approximately 200 $in^3$.

Figure 3:
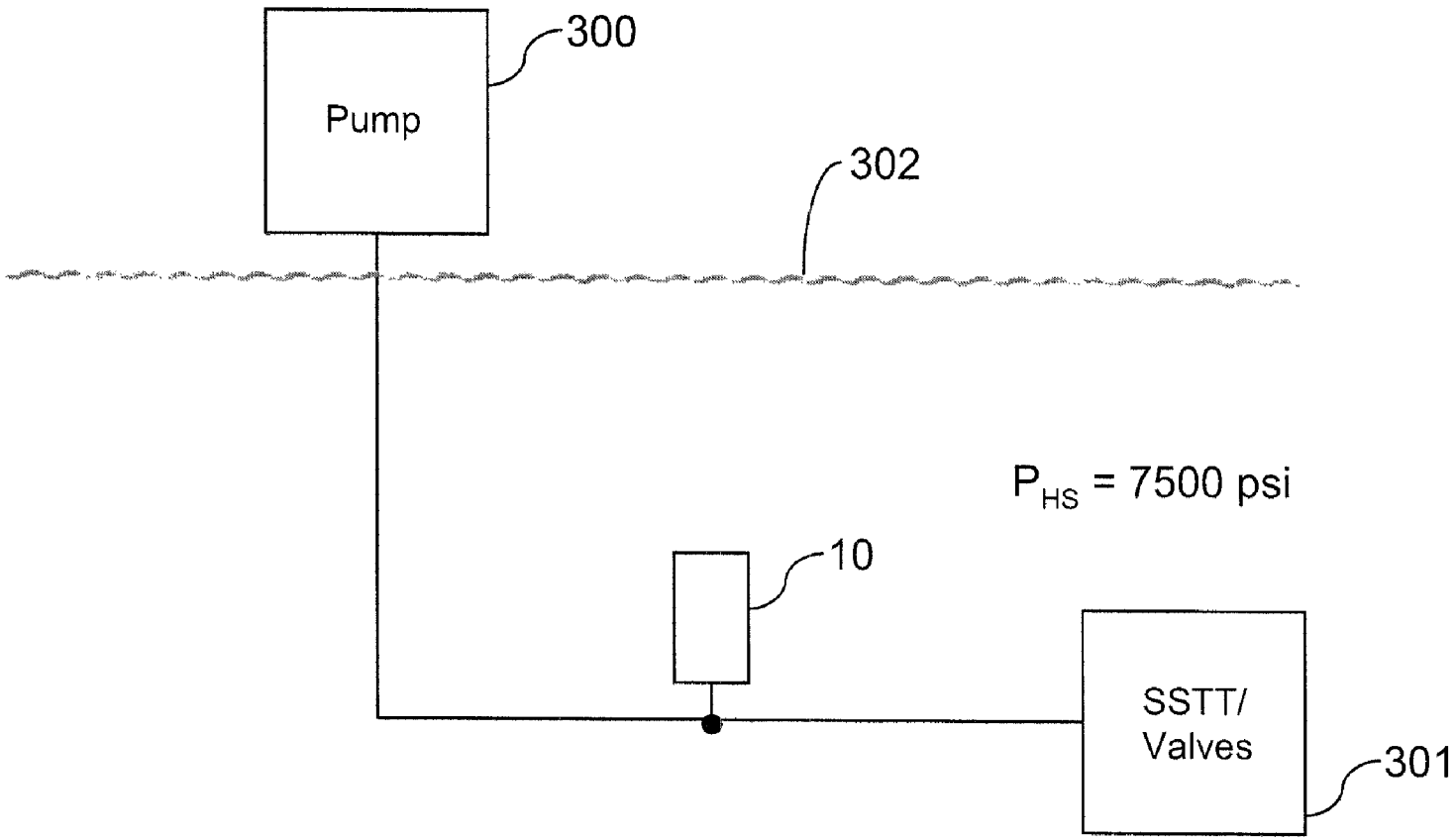
FIG. 3 is a pictorial diagram which illustrates a system utilizing apparatus in accordance with the present invention.

With reference to FIGS. 1, 2 and 3 the operation of apparatus 10 is as follows. In operation, apparatus 10 in accordance with the present invention may be located in a subsea environment to control the operation of an in-riser or open water intervention system, such as SSTTs and/or valves 301 associated therewith. The first and second chamber 14 and 16 in accumulator 12 of apparatus 10 are precharged prior to placement of apparatus 10 in the subsea environment. Pump 300, which is located above the sea surface 302, provides the control fluid for the operation of BOP/valves 301 and also provides a charging input to chamber 16 of accumulator 12 in apparatus 10.

For purposes of illustration, it will be assumed that the hydrostatic pressure, $P_{HS}$, in which apparatus 10 is operating is 7500 psi. This ambient pressure is communicated through ambient pressure port 24 of apparatus 10 and impinges on end 20*a* of piston 20. The force acting on piston 20 at its end 20*a* will be given by the formula:

$$F1 = P_{HS} \times (\text{the area of piston end } 20a). \quad (1)$$

The force on end 20*b* of piston 20 is given by the formula:

$$F2 = (P_{HS} + 5000) \times (\text{the area of piston end } 20b). \quad (2)$$

In one embodiment of the present invention, piston ends 20*a* and 20*b* are circular in cross-sectional areas and have diameters of 3.375 inches and 2.688 inches, respectively. At the hydrostatic pressure of 7500 psi, the equilibrium pressure, $P_E$, at which the piston starts to move is:

$$P_E = 7500\left(\frac{3.375}{2.688}\right)^2 = 11{,}824 \text{ lbf}. \quad (3)$$

The gauge pressure $P_G$ at which the piston will begin to move is given by the formula:

$$P_G = P_E - P_{HS} \quad (4)$$
$$= 11{,}824 - 7{,}500$$
$$P_G = 4{,}324 \text{ psi}$$

In accordance with the present invention, the diameter of piston ends 20*a* ($D_1$) and 20*b* ($D_2$) may be sized for optimal efficiency at a predetermined hydrostatic pressure, using the following formula:

$$D_1 = \sqrt{\frac{(P_{HS} + P_C - S)}{P_{HS}}} \cdot D_2 \quad (5)$$

where $P_C$ is the pressure to which the second chamber of accumulator 12 is charged, e.g., 5000 psi and S is a hydraulic safety factor which is an allowance given to prevent instability in maximum hydrostatic conditions. For a hydrostatic pressure of 7500 psi, S is approximately 500 psi. If $D_2$=2.688 inches as in the above calculation with respect to equations (3) and (4) then $D_4$ according to equation (5) is 3.40 inches.

Figure 4:
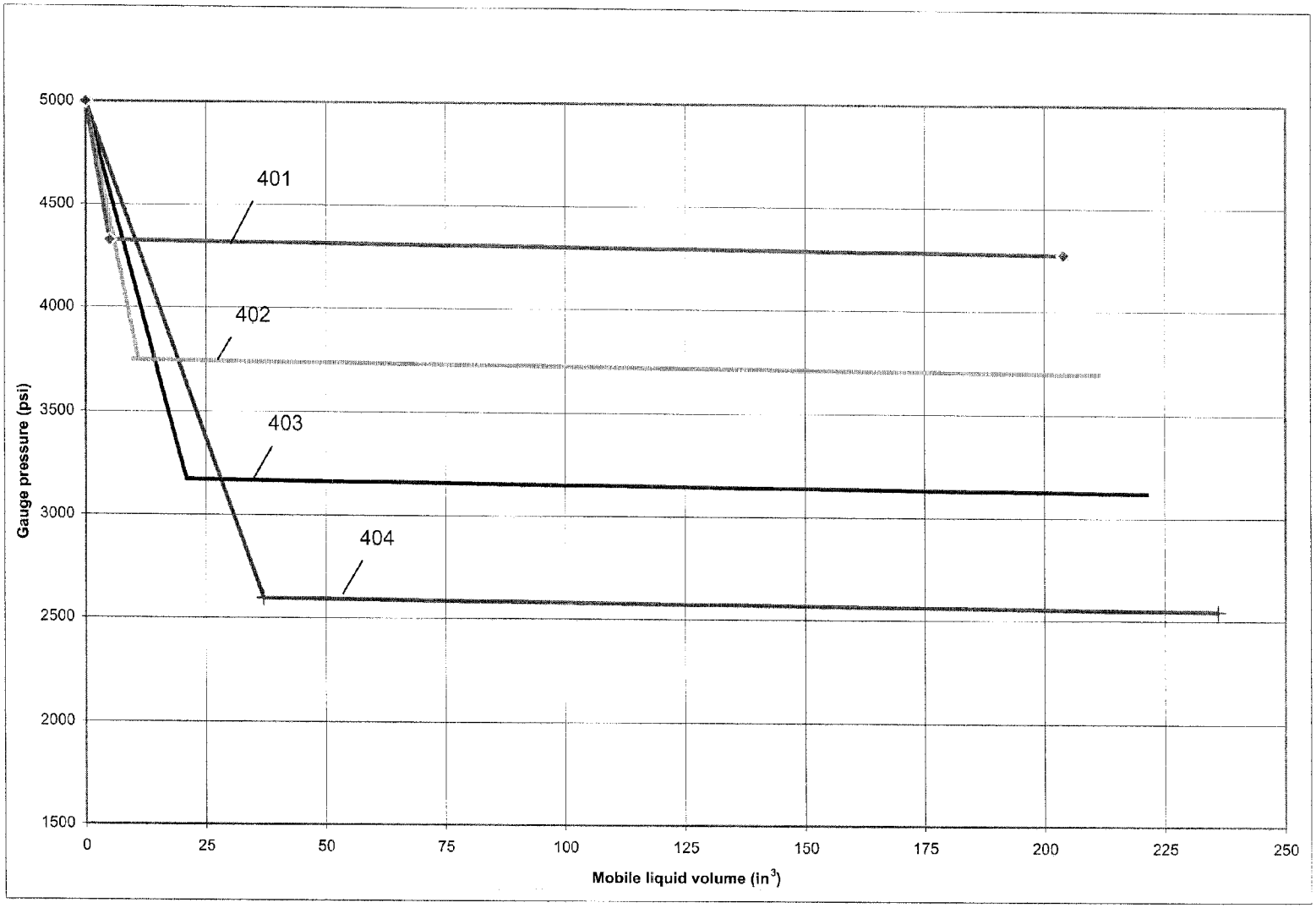
FIG. 4 is a graph which illustrates the gauge pressures at which the piston in FIGS. 1 and 2 begins to expel fluid from the accumulator for piston diameters $D_1$ and $D_2$ of 3.375 and 2.6875 inches, respectively.

Referring to FIG. 4, graph 401 illustrates the fluid volume which will be expelled from the accumulator 12 at a hydrostatic pressure of 7500 psi and with $D_1$ and $D_2$ of FIG. 2 being 3.375 inches and 2.688 inches, respectively. Graphs 402, 403 and 404 illustrate fluid volume expelled at hydrostatic pressures of 6500, 5500 and 4500 psi, respectively.

What is claimed is:

1. A method of controlling a subsea test tree, comprising:

establishing a pressure balanced accumulator for providing control fluid to the system comprising a chamber with pressurized hydraulic fluid and a piston having first and second ends where the diameter of the first and second ends are $D_1$ and $D_2$, respectively and where the diameter $D_1$ is selecting using the equation $$D_1 = \sqrt{\frac{(P_{HS} + P_C - S)}{P_{HS}}} \cdot D_2$$

where $P_{HS}$ is hydrostatic pressure to which the accumulator will be subjected, $P_C$ is the pressure of the fluid in the chamber with hydraulic fluid, and S is a safety factor pressure;

communicating the hydrostatic pressure to the first end of the piston; and communicating a pressure equal to hydrostatic pressure plus the hydraulic pressure of the chamber to the second end of the piston.

2. A method of controlling an in-riser system, comprising:

locating the in-riser system within a subsea riser, the in riser-system comprising a pressure-balanced accumulator;

establishing the pressure-balanced accumulator for providing control fluid where the accumulator comprises a chamber containing hydraulic fluid under pressure and a piston having first and second ends and where the accumulator is subject to a hydrostatic pressure;

communicating the hydrostatic pressure of the first end of the piston; and communicating a pressure equal to hydrostatic pressure plus the hydraulic pressure of the chamber to the second end of the piston.

3. The method of claim 2 further comprising the step of expelling hydraulic fluid from the chamber once an equilibrium pressure exists across the piston.

4. The method of claim 1, further comprising applying the hydraulic pressure to an outside of the first end of the piston in a first direction toward the piston and applying the hydrostatic pressure to an outside of the second end of the piston in a second direction toward the piston, the first direction and the second direction being opposite to one another.

5. The method of claim 4, comprising placing the piston in tension.

* * * * *